US010016886B2

(12) United States Patent
Wang

(10) Patent No.: US 10,016,886 B2
(45) Date of Patent: Jul. 10, 2018

(54) TOOL COMBINATION

(71) Applicant: Beto Engineering & Marketing Co., Ltd., Taichung (TW)

(72) Inventor: Lo Pin Wang, Taichung (TW)

(73) Assignee: Beto Engineering & Marketing Co., Ltd., Beitun, Taichung (TW)

( * ) Notice: Subject to any disclaimer, the term of this patent is extended or adjusted under 35 U.S.C. 154(b) by 229 days.

(21) Appl. No.: 15/197,982

(22) Filed: Jun. 30, 2016

(65) Prior Publication Data

US 2018/0001465 A1 Jan. 4, 2018

(51) Int. Cl.

| | |
|---|---|
| ***B25F 1/04*** | (2006.01) |
| ***B25B 15/00*** | (2006.01) |
| ***B25G 1/08*** | (2006.01) |

(52) U.S. Cl.

CPC ..... *B25F 1/04* (2013.01); *B25B 15/00* (2013.01); *B25G 1/085* (2013.01)

(58) Field of Classification Search

CPC . B25F 1/04; B25F 1/003; B25B 15/00; B25B 15/008; B25B 13/56; B25G 1/085

See application file for complete search history.

(56) References Cited

U.S. PATENT DOCUMENTS

| | | | | |
|---|---|---|---|---|
| 4,759,645 | A | 7/1988 | Kuo | |
| 5,267,366 | A * | 12/1993 | Frazer | B25F 1/04 7/128 |
| 5,421,180 | A | 6/1995 | Rojdev | |
| 5,791,211 | A | 8/1998 | Bondhus et al. | |
| 6,298,756 | B1 | 10/2001 | Anderson et al. | |
| 9,089,960 | B2 | 7/2015 | Wang | |
| 2014/0041128 | A1* | 2/2014 | Wang | B25F 1/04 7/118 |

* cited by examiner

*Primary Examiner* — Robert Scruggs
(74) *Attorney, Agent, or Firm* — Charles E. Baxley

(57) ABSTRACT

A tool combination includes two housings each having a chamber formed by a base panel and two side panels, an axle and a shaft are secured between end portions of the housings, a tool assembly includes one or more tool members having ring members engaged with the axle and to be pivoted out and selectively folded and engaged into the space that is formed between the housings, another tool assembly includes one or more tool members having ring members engaged with the shaft and to be pivoted out and selectively folded and engaged into the space that is formed between the housings, and one or more tool assemblies are selectively and pivotally attached to either of the housings.

7 Claims, 6 Drawing Sheets

TOOL COMBINATION

BACKGROUND OF THE INVENTION

1. Field of the Invention

The present invention relates to a tool device or assembly or combination, and more particularly to a tool device or assembly or combination including a number of tool elements or tool members pivotally or rotatably received or engaged in a carrier housing for forming a compact folding or receiving structure and for allowing much more tool elements or tool members to be easily carried and operated by the user.

2. Description of the Prior Art

Typical tool devices or assemblies or combinations comprise a number of tool elements or tool members pivotally or rotatably attached or mounted or secured to a carrier housing with a pivot shaft or axle and foldable and receivable into a receiving or engaging chamber or compartment of the carrier housing in a compact folding or receiving structure.

For example, U.S. Pat. No. 4,759,645 to Kuo, U.S. Pat. No. 5,421,180 to Rojdev, U.S. Pat. No. 5,791,211 to Bondhus et al., U.S. Pat. No. 6,298,756 to Anderson et al., and U.S. Pat. No. 9,089,960 to Wang disclose several of the typical tool devices or assemblies or combinations each also comprising a carrier housing for being carried or held by the user, and a number of tool elements or tool members pivotally or rotatably attached or mounted or secured to the carrier housing and foldable and receivable or engageable into the carrier housing for forming a compact folding or receiving structure.

However, only few tool elements or tool members of few sizes or dimensions or standards may be received or engaged in the carrier housing, and the carrier housing may not provide much more tool elements or tool members for being easily carried and operated by the user.

The present invention has arisen to mitigate and/or obviate the afore-described disadvantages of the conventional tool devices or assemblies or combinations.

SUMMARY OF THE INVENTION

The primary objective of the present invention is to provide a tool device or assembly or combination including a number of tool elements or tool members pivotally or rotatably received or engaged in a carrier housing for forming a compact folding or receiving structure and for allowing much more tool elements or tool members to be easily carried and operated by the user.

In accordance with one aspect of the invention, there is provided a tool combination comprising a first housing including a first end portion and a second end portion, the first housing including a chamber formed therein and defined by a base panel and two side panels, and the first housing including a spindle disposed thereon, a second housing including a first end portion and a second end portion, the second housing including a chamber formed therein and defined by a base panel and two side panels, and the second housing including a pivot rod disposed thereon, the first end portions of the first and the second housings being secured together with an axle, and the second end portions of the first and the second housings being secured together with a shaft for separating the first and the second housings from each other and for forming a space between the first and the second housings, a first tool assembly including a first tool member and at least one second tool member, the first and the second tool members each including a ring member engaged with the axle for pivotally attaching to the first and the second housings with the axle and for allowing the first and the second tool members to be selectively pivoted and rotated out and to be selectively folded and engaged into the space that is formed between the first and the second housings, and the first tool assembly including a washer engaged between the ring members of the first and the second tool members, a second tool assembly including a third tool member and at least one fourth tool member, the third and the fourth tool members each including a ring member engaged with the shaft for pivotally attaching to the first and the second housings with the shaft and for allowing the third and the fourth tool members to be selectively pivoted and rotated out and to be selectively folded and engaged into the space that is formed between the first and the second housings, and the second tool assembly including a washer engaged between the ring members of the third and the fourth tool members, a third tool assembly including a fifth tool member and at least one sixth tool member, the fifth and the sixth tool members each including a ring member engaged with the spindle for pivotally attaching to the first housing with the spindle and for allowing the fifth and the sixth tool members to be selectively pivoted and rotated out and to be selectively folded and engaged into the first housing, and the third tool assembly including a washer engaged between the ring members of the fifth and the sixth tool members, and a fourth tool assembly including a seventh tool member and at least one eighth tool member, the seventh tool member and the eighth tool members each including a ring member engaged with the pivot rod for pivotally attaching to the second housing with the pivot rod and for allowing the seventh and the eighth tool members to be selectively pivoted and rotated out and to be selectively folded and engaged into the second housing, and the fourth tool assembly including a washer engaged between the ring members of the seventh and the eighth tool members, for allowing the tool combination to have a number of tool members pivotally or rotatably received or engaged in the housings for forming a compact folding or receiving structure and for allowing much more tool elements or tool members to be easily carried and operated by the user.

The first housing includes two side panels for attaching or supporting the spindle. The first housing includes a chamber formed therein and defined by a base panel and the side panels, the spindle is extended or straddled between the side panels of the first housing and extended through the chamber of the first housing for allowing the third tool member to be selectively pivoted and rotated out and to be selectively folded and engaged into the chamber of the first housing.

The second housing includes two side panels for attaching or supporting the pivot rod. The second housing includes a chamber formed therein and defined by a base panel and the side panels, the pivot rod is extended or straddled between the side panels of the second housing and extended through the chamber of the second housing for allowing the fourth tool member to be selectively pivoted and rotated out and to be selectively folded and engaged into the chamber of the second housing and to be suitably stored within the second housing.

The first housing includes a fifth tool assembly having a ninth tool member and at least one tenth tool member, the ninth and the tenth tool members each include a ring member engaged with the first housing with a pivot pole for pivotally attaching the ninth and the tenth tool members to the first housing with the pivot pole and for allowing the ninth and the tenth tool members to be selectively pivoted and rotated out and to be selectively folded and engaged into the first housing, and the fifth tool assembly includes a washer engaged between the ring members of the ninth and the tenth tool members for suitably spacing the ninth and the tenth tool members away from each other.

The second housing includes a six tool assembly having an eleventh tool member and at least one twelfth tool member, the eleventh and the twelfth tool members each include a ring member engaged with the second housing with a pivot post for pivotally attaching to the second housing with the pivot post and for allowing the eleventh and the twelfth tool members to be selectively pivoted and rotated out and to be selectively folded and engaged into the second housing, and the fifth tool assembly includes a washer engaged between the ring members of the eleventh and the twelfth tool members for suitably spacing the eleventh and the twelfth tool members away from each other.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
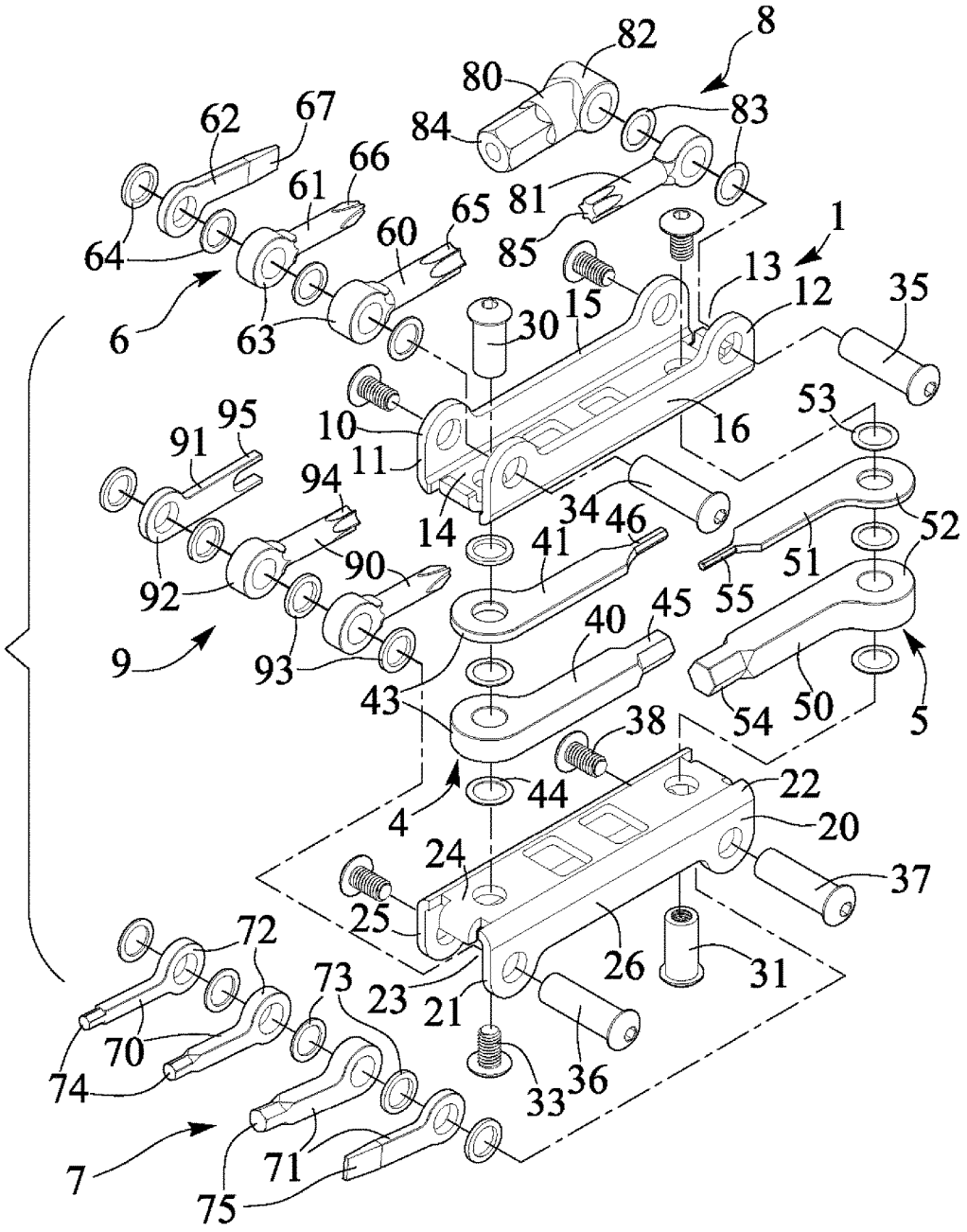
FIG. 1 is an exploded view of a tool device or assembly or combination in accordance with the present invention.
Figure 2:
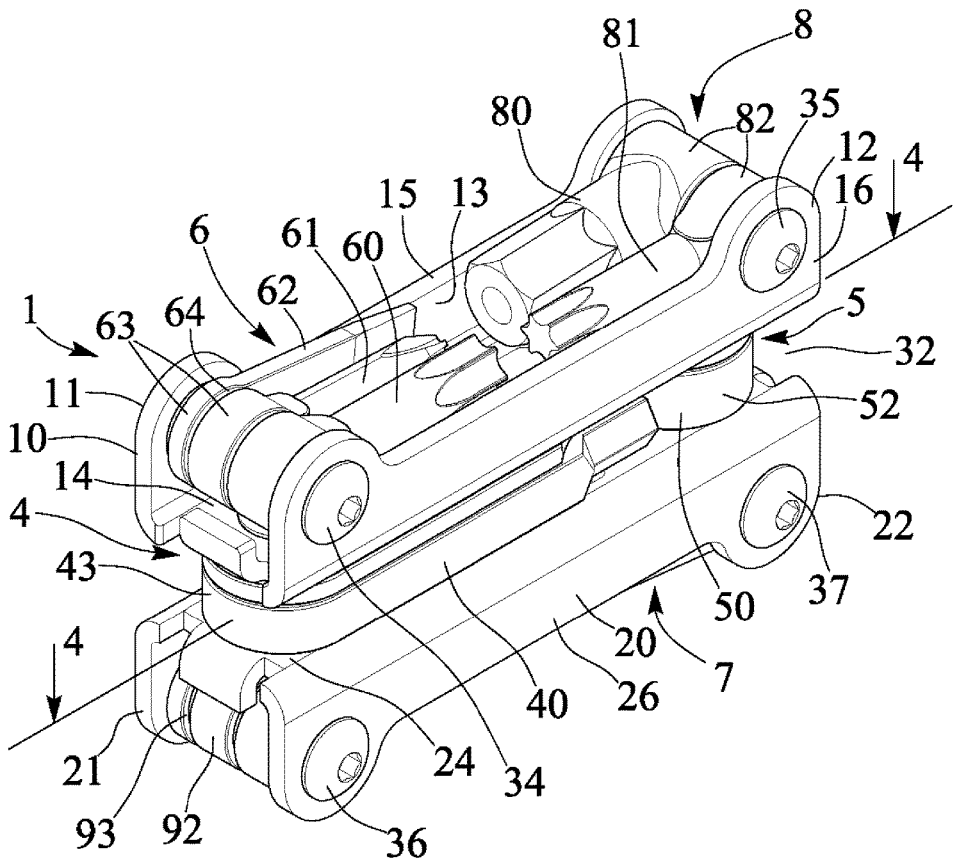
FIG. 2 is an upper perspective view of the tool device or assembly or combination.
Figure 3:
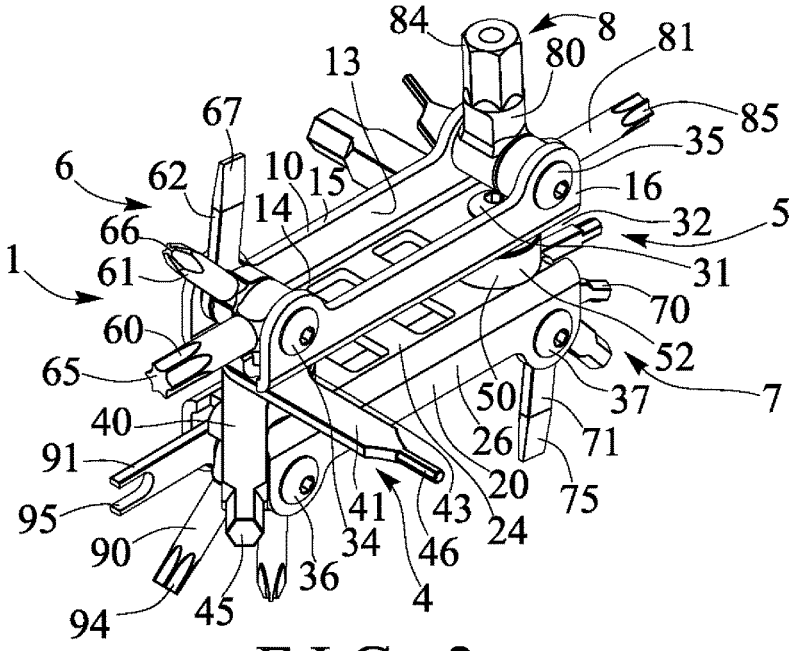
FIG. 3 is another upper perspective view similar to FIG. 2, illustrating the operation of the tool device or assembly or combination as shown in FIGS. 1 and 2.

Referring to the drawings, and initially to FIGS. 1-4, a tool device or assembly or combination in accordance with the present invention comprises a carrier housing device 1 including an upper carrier or first housing 10 and a lower carrier or second housing 20 each having two end portions 11, 21; 12, 22 connected or coupled or secured together with an axle 30 and a shaft 31, i.e., one or first end portions 11, 21 of the housings 10, 20 are coupled or secured together with the axle 30 and the other or second end portions 21, 22 of the housings 10, 20 are coupled or secured together with the shaft 31, for suitably separating the housings 10, 20 from each other and for forming or defining a gap or space 32 between the housings 10, 20, best shown in FIGS. 1-3. The axle 30 and the shaft 31 may be solidly and stably attached or mounted or secured to the housings 10, 20 with a screw, bolt, fastener 33 or the like.

Figure 4:
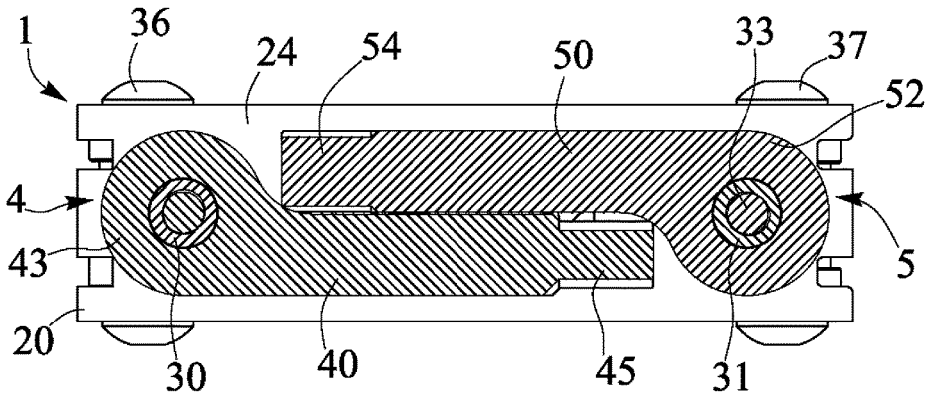
FIG. 4 is a cross sectional view of the tool device or assembly or combination, taken along lines 4-4 of FIG. 2.
Figure 5:
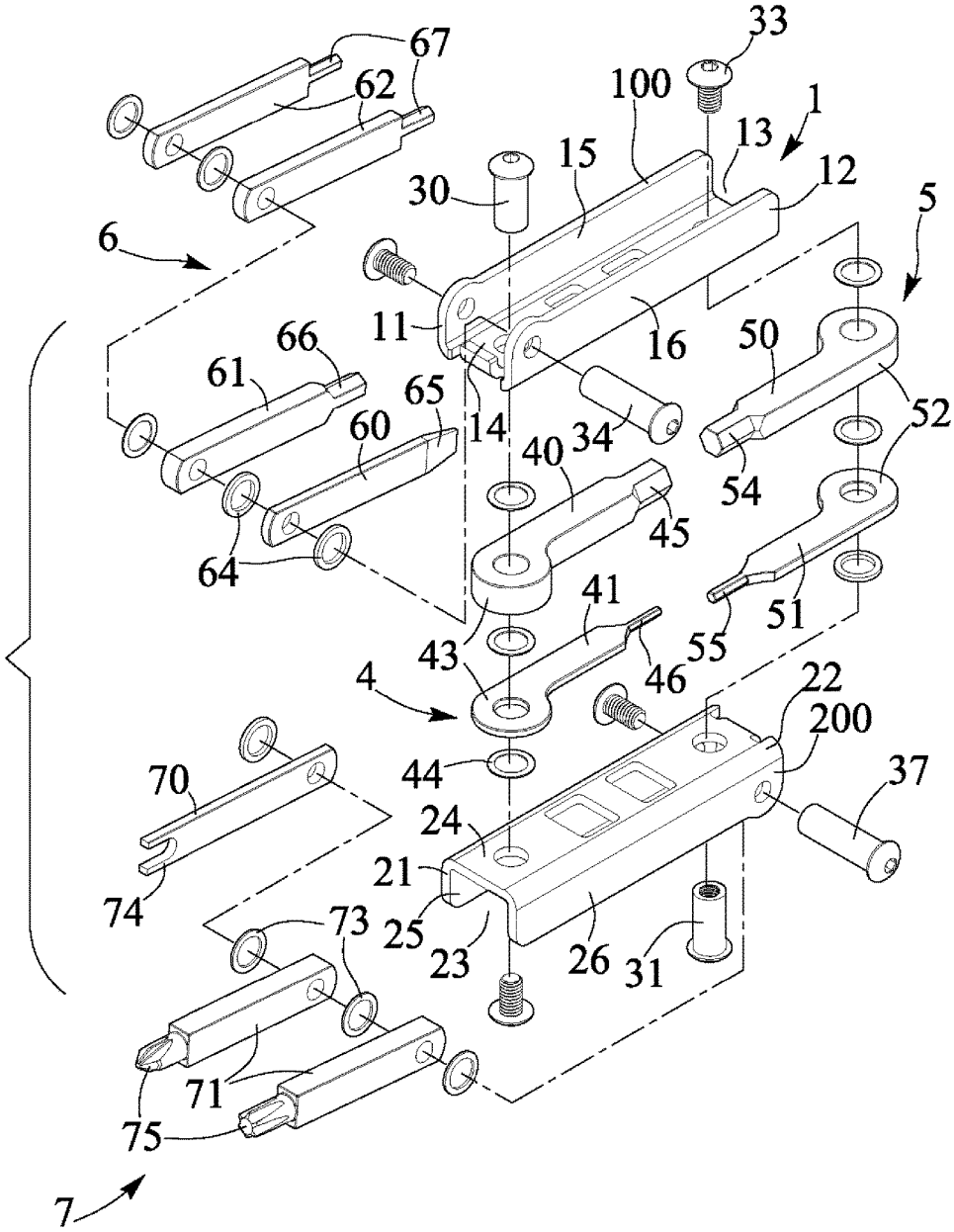
FIG. 5 is an exploded view similar to FIG. 1, illustrating the other arrangement of the tool device or assembly or combination.

A first tool device or assembly 4 includes one or more tool elements or tool members 40, 41 received or engaged in the space 32 that is formed between the housings 10, 20, and each tool member 40, 41 having a loop or ring member 43 for engaging with the axle 30 and for pivotally or rotatably attaching or mounting or securing the tool members 40-41 to the housings 10, 20 with the axle 30, and one or more spacers or washers 44 are disposed or attached or mounted and engaged between the ring members 43 of the tool members 40-41 for suitably separating the tool members 40-41 from each other and for allowing the tool members 40-41 to be smoothly pivoted or rotated relative to the housings 10, 20 and to be selectively pivoted or rotated out of the housings 10, 20 (FIG. 3) or to be selectively pivoted or rotated or folded or stored or received or engaged into the space 32 that is formed between the housings 10, 20 (FIGS. 2, 4). The tool members 40-41 may include tips or tool elements or portions 45, 46 of different sizes or shapes or contours or dimensions or standards.

A second tool device or assembly 5 includes one or more tool members or tool members 50, 51 each having a loop or ring member 52 for engaging with the shaft 31 and for pivotally or rotatably attaching or mounting or securing the tool members 50-51 to and between the housings 10, 20 with the shaft 31, and one or more spacers or washers 53 are disposed or attached or mounted and engaged between the ring members 52 of the tool members 50-51 for suitably separating the tool members 50-51 from each other and for allowing the tool members 50-51 to be smoothly pivoted or rotated relative to the housings 10, 20 and to be selectively pivoted or rotated out of the housings 10, 20 (FIG. 3) or to be selectively pivoted or rotated or folded or stored or received or engaged into the space 32 that is formed between the housings 10, 20 (FIGS. 2, 4). The tool members 50-51 may include tips or tool elements or portions 54, 55 of different sizes or shapes or contours or dimensions or standards.

The upper and the lower housings 10, 20 each include a compartment or chamber 13. 23 formed therein and formed or defined by a bottom or base wall or panel 14, 25 and two side walls or panels 15, 16; 25, 26. A spindle 34 and a pivot post 36 are attached or mounted or secured to the one end or first end portion 11, 21 of the respective housing 10, 20 with a fastener 38 and extended or straddled and coupled between the side panels 15, 16; 25, 26 of the housing 10, 20 and extended through the chamber 13, 23 of the housing 10, 20, and a pivot pole 35 and a pivot rod 37 are attached or mounted or secured to the other or second end portion 12, 22 of each of the housings 10, 20 with a fastener 38 and extended or straddled and coupled between the side panels 15, 16; 25, 26 of the housing 10, 20 and also extended through the chamber 13, 23 of the housing 10, 20 and parallel to the spindle 34 and the pivot post 36, but perpendicular to the axle 30 and the shaft 31.

A third tool device or assembly 6 includes one or more tool elements or tool members 60, 61, 62 each having a loop or ring member 63 for engaging with the spindle 34 that is attached to the first end portion 11 of the first housing 10, and for pivotally or rotatably attaching or mounting or securing the tool members 60-62 to the housing 10 with the spindle 34, and one or more spacers or washers 64 are disposed or attached or mounted and engaged between the ring members 63 of the tool members 60-62 for suitably separating the tool members 60-62 from each other and for allowing the tool members 60-62 to be smoothly pivoted or rotated relative to the housing 10 and to be selectively pivoted or rotated out of the housing 10 (FIG. 3) or to be selectively pivoted or rotated or folded or stored or received or engaged into the chamber 13 of the housing 10 (FIGS. 2, 4). The tool members 60-62 may include tips or tool portions 65, 66, 67 of different sizes or shapes or contours or dimensions or standards.

A fourth tool device or assembly 7 includes one or more tool elements or tool members 70, 71 each having a loop or ring member 72 for engaging with the pivot rod 37 that is attached to the second end portion 22 of the second housing 20, and for pivotally or rotatably attaching or mounting or securing the tool members 70-71 to the second housing 20 with the pivot rod 37, and one or more spacers or washers 73 are disposed or attached or mounted and engaged between the ring members 72 of the tool members 70-71 for suitably separating the tool members 70-71 from each other and for allowing the tool members 70-71 to be smoothly pivoted or rotated relative to the second housing 20 and to be selectively pivoted or rotated out of the second housing 20 (FIG. 3) or to be selectively pivoted or rotated or folded or stored or received or engaged into the chamber 23 of the second housing 20 (FIGS. 2, 4). The tool members 70-71 may include tips or tool portions 74, 75 of different sizes or shapes or contours or dimensions or standards.

A fifth tool device or assembly 8 includes one or more tool elements or tool members 80, 81 each having a loop or ring member 82 for engaging with the pivot pole 35 that is attached to the second end portion 12 of the first housing 10, and for pivotally or rotatably attaching or mounting or securing the tool members 80-81 to the first housing 10 with the pivot pole 35, and one or more spacers or washers 83 are disposed or attached or mounted and engaged between the ring members 82 of the tool members 80-81 for suitably separating the tool members 80-81 from each other and for allowing the tool members 80-81 to be smoothly pivoted or rotated relative to the first housing 10 and to be selectively pivoted or rotated out of the first housing 10 (FIG. 3) or to be selectively pivoted or rotated or folded or stored or received or engaged into the chamber 13 of the first housing 10 (FIGS. 2, 4). The tool members 80-81 may include tips or tool portions 84, 85 of different sizes or shapes or contours or dimensions or standards.

A sixth tool device or assembly 9 includes one or more tool elements or tool members 90, 91 each having a loop or ring member 92 for engaging with the pivot post 36 that is attached to the second end portion 22 of the second housing 20, and for pivotally or rotatably attaching or mounting or securing the tool members 90-91 to the second housing 20 with the pivot post 36, and one or more spacers or washers 93 are disposed or attached or mounted and engaged between the ring members 92 of the tool members 90-91 for suitably separating the tool members 90-91 from each other and for allowing the tool members 90-91 to be smoothly pivoted or rotated relative to the second housing 20 and to be selectively pivoted or rotated out of the second housing 20 (FIG. 3) or to be selectively pivoted or rotated or folded or stored or received or engaged into the chamber 23 of the second housing 20 (FIGS. 2, 4). The tool members 90-91 may include tips or tool portions 94, 95 of different sizes or shapes or contours or dimensions or standards.

Figure 6:
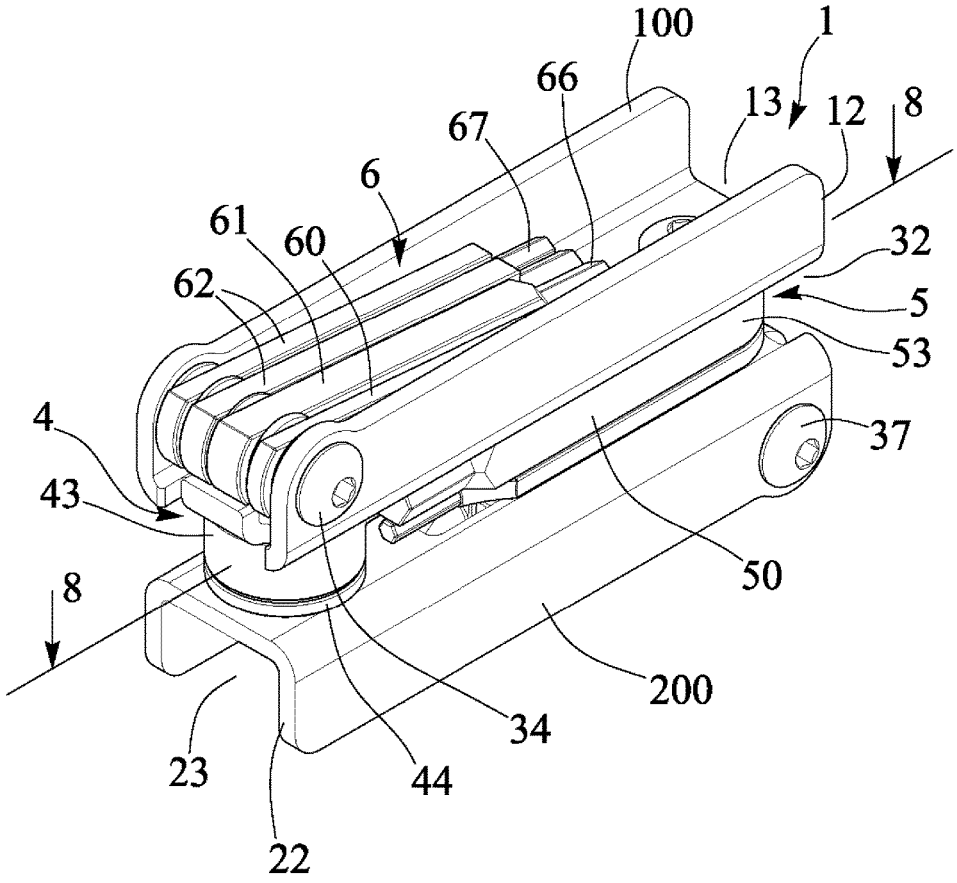
FIG. 6 is an upper perspective view of the tool device or assembly or combination as shown in FIG. 5.
Figure 7:
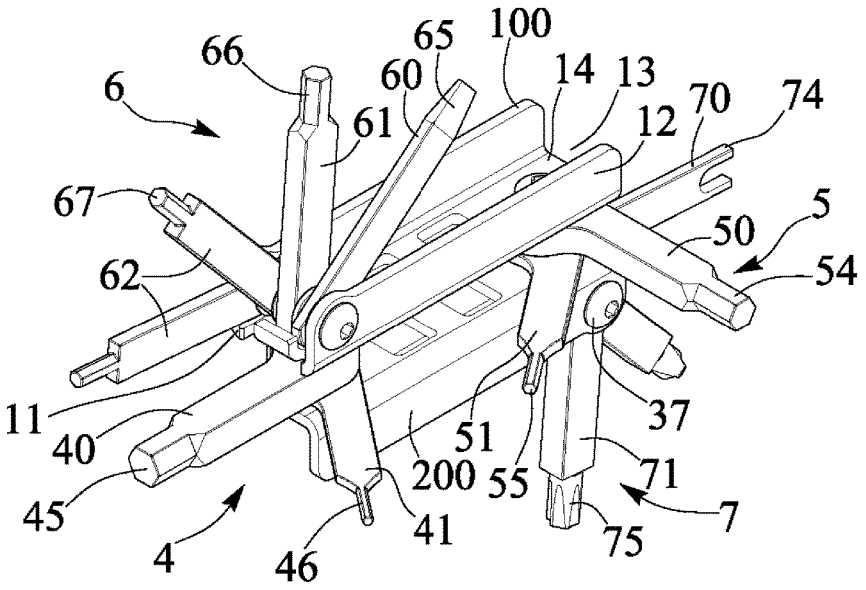
FIG. 7 is a further upper perspective view similar to FIG. 6, illustrating the operation of the tool device or assembly or combination as shown in FIGS. 5 and 6.
Figure 8:
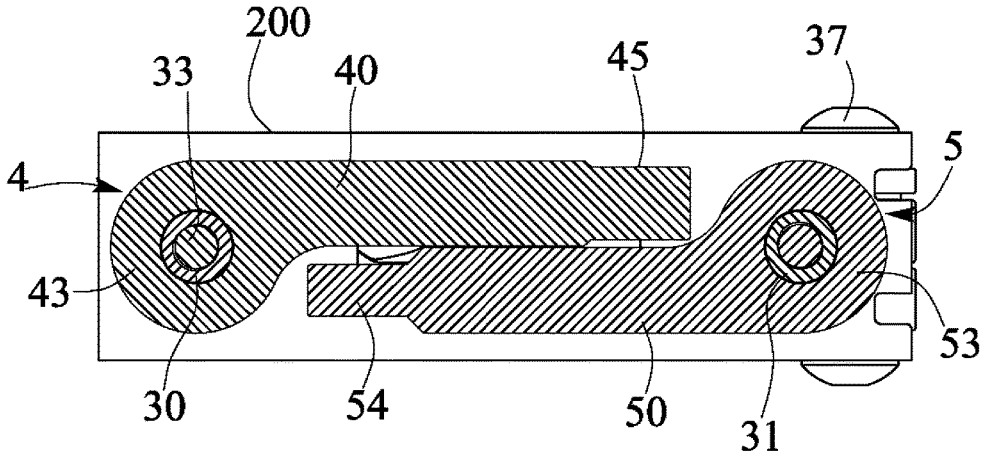
FIG. 8 is a cross sectional view of the tool device or assembly or combination, taken along lines 8-8 of FIG. 6.

Alternatively, as shown in FIGS. 5-8, the first housing 100 may include only the third tool device or assembly 6 having the tool members 60-62 pivotally or rotatably attached or mounted or secured to the first housing 100 with the spindle 34, and to be selectively pivoted or rotated out of the housing 100 (FIG. 7) or to be selectively pivoted or rotated or folded or stored or received or engaged into the chamber 13 of the housing 100 (FIGS. 6, 8), and the second housing 20 may include only the fourth tool device or assembly 7 having the tool members 70-71 pivotally or rotatably attached or mounted or secured to the second housing 20 with the pivot rod 37, and to be selectively pivoted or rotated out of the second housing 20 (FIG. 3) or to be selectively pivoted or rotated or folded or stored or received or engaged into the chamber 23 of the second housing 20 (FIGS. 2, 4), and the first and the second tool devices or assemblies 4, 5 have the tool members 40-41, 50-51 pivotally or rotatably attached or mounted or secured to the housings 100, 200 with the axle 30 and the shaft 31 respectively, and to be selectively pivoted or rotated out of the housings 100, 200 (FIG. 7) or to be selectively pivoted or rotated or folded or stored or received or engaged into the space 32 that is formed between the housings 100, 200 (FIGS. 6, 8).

It is to be noted that the axle 30 is perpendicular to the spindle 34 and the pivot rod 37 and the pivot pole 35 and the pivot post 36 and parallel to the shaft 31, and the spindle 34 is perpendicular to the shaft 31 and the axle 30 and parallel to the pivot rod 37 and the pivot pole 35 and the pivot post 36, and the tool members 40-41, 50-51 of the first and the second tool devices or assemblies 4, 5 may be folded or stored or received or engaged into the space 32 that is formed between the housings 10, 20, and the tool members 50-52 of the third and the fifth tool devices or assemblies 6, 8 may be folded or stored or received or engaged into the chamber 13 of the housing 10, and the tool members 70-71, 90-91 of the fourth and the sixth tool devices or assemblies 7, 9 may be folded or stored or received or engaged into the chamber 23 of the second housing 20 such that the tool combination may include many more tool elements or tool members to be easily carried and operated by the user.

Accordingly, the tool combination in accordance with the present invention includes a number of tool elements or tool members pivotally or rotatably received or engaged in a carrier housing for forming a compact folding or receiving structure and for allowing many more tool elements or tool members to be easily carried and operated by the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool combination comprising:

a first housing including a first end portion and a second end portion, said first housing including a chamber formed therein and defined by a base panel and two side panels, and said first housing including a spindle disposed thereon, a second housing including a first end portion and a second end portion, said second housing including a chamber formed therein and defined by a base panel and two side panels, and said second housing including a pivot rod disposed thereon, said first end portions of said first and said second housings being secured together with an axle, and said second end portions of said first and said second housings being secured together with a shaft for separating said first and said second housings from each other and for forming a space between said first and said second housings, a first tool assembly including a first tool member and at least one second tool member, said first and said at least one second tool members each including a ring member engaged with said axle for pivotally attaching to said first and said second housings with said axle and for allowing said first and said at least one second tool members to be selectively pivoted and rotated out and to be selectively folded and engaged into said space that is formed between said first and said second housings, and said first tool assembly including a washer engaged between said ring members of said first and said at least one second tool members, a second tool assembly including a third tool member and at least one fourth tool member, said third and said at least one fourth tool members each including a ring member engaged with said shaft for pivotally attaching to said first and said second housings with said shaft and for allowing said third and said at least one fourth tool members to be selectively pivoted and rotated out and to be selectively folded and engaged into said space that is formed between said first and said second housings, and said second tool assembly including a washer engaged between said ring members of said third and said at least one fourth tool members, a third tool assembly including a fifth tool member and at least one sixth tool member, said fifth and said at least one sixth tool members each including a ring member engaged with said spindle for pivotally attaching to said first housing with said spindle and for allowing said fifth and said at least one sixth tool members to be selectively pivoted and rotated out and to be selectively folded and engaged into said first housing, and said third tool assembly including a washer engaged between said ring members of said fifth and said at least one sixth tool members, and a fourth tool assembly including a seventh tool member and at least one eighth tool member, said seventh tool member and said at least one eighth tool members each including a ring member engaged with said pivot rod for pivotally attaching to said second housing with said pivot rod and for allowing said seventh and said at least one eighth tool members to be selectively pivoted and rotated out and to be selectively folded and engaged into said second housing, and said fourth tool assembly including a washer engaged between said ring members of said seventh and said at least one eighth tool members.

2. The tool combination as claimed in claim 1, wherein said first housing includes two side panels for attaching said spindle.

3. The tool combination as claimed in claim 2, wherein said first housing includes a chamber formed therein and defined by a base panel and said side panels, said spindle is straddled between said side panels of said first housing and extended through said chamber of said first housing for allowing said third tool member to be selectively pivoted and rotated out and to be selectively folded and engaged into said chamber of said first housing.

4. The tool combination as claimed in claim 1, wherein said second housing includes two side panels for attaching said pivot rod.

5. The tool combination as claimed in claim 4, wherein said second housing includes a chamber formed therein and defined by a base panel and said side panels, said pivot rod is straddled between said side panels of said second housing and extended through said chamber of said second housing for allowing said fourth tool member to be selectively pivoted and rotated out and to be selectively folded and engaged into said chamber of said second housing.

6. The tool combination as claimed in claim 1, wherein said first housing includes a fifth tool assembly having a ninth tool member and at least one tenth tool member, said ninth and said at least one tenth tool members each including a ring member engaged with said first housing with a pivot pole for pivotally attaching to said first housing with said pivot pole and for allowing said ninth and said at least one tenth tool members to be selectively pivoted and rotated out and to be selectively folded and engaged into said first housing, and said fifth tool assembly includes a washer engaged between said ring members of said ninth and said at least one tenth tool members.

7. The tool combination as claimed in claim 1, wherein said second housing includes a six tool assembly having an eleventh tool member and at least one twelfth tool member, said eleventh and said at least one twelfth tool members each including a ring member engaged with said second housing with a pivot post for pivotally attaching to said second housing with said pivot post and for allowing said eleventh and said at least one twelfth tool members to be selectively pivoted and rotated out and to be selectively folded and engaged into said second housing, and said fifth tool assembly includes a washer engaged between said ring members of said eleventh and said at least one twelfth tool members.

* * * * *